US009861992B1

(12) United States Patent
Chen

(10) Patent No.: US 9,861,992 B1
(45) Date of Patent: Jan. 9, 2018

(54) GARDENING WATER SPRAY GUN

(71) Applicant: Chin-Yuan Chen, Changhua (TW)

(72) Inventor: Chin-Yuan Chen, Changhua (TW)

(73) Assignee: Shin Tai Spurt Water of the Garden Tools Co. Ltd., Changhua (TW)

( * ) Notice: Subject to any disclaimer, the term of this patent is extended or adjusted under 35 U.S.C. 154(b) by 0 days.

(21) Appl. No.: 15/363,484

(22) Filed: Nov. 29, 2016

(51) Int. Cl.
*B05B 1/30* (2006.01)
*B05B 9/01* (2006.01)

(52) U.S. Cl.
CPC ..... *B05B 1/3026* (2013.01); *B05B 9/01* (2013.01)

(58) Field of Classification Search
CPC ..... B05B 1/3026; B05B 9/01; B05B 1/30
See application file for complete search history.

(56) References Cited

U.S. PATENT DOCUMENTS 6,073,863 A * 6/2000 Wang ..... B05B 1/3026 239/525
7,240,858 B2 * 7/2007 Wang ..... B05B 1/3013 239/395
7,328,860 B1 * 2/2008 Chen ..... B05B 1/3026 137/625.31
7,429,029 B2 * 9/2008 Wang ..... F16K 5/0478 239/526
8,381,769 B2 * 2/2013 Hsieh ..... B05B 1/3013 137/614.19
8,490,948 B2 * 7/2013 Lu ..... A01G 25/00 239/526
8,596,558 B2 * 12/2013 Lai ..... B05B 9/01 239/525
8,950,693 B2 * 2/2015 Hsieh ..... B05B 1/3026 239/525
9,073,075 B2 * 7/2015 Chen ..... B05B 1/3026
2013/0015270 A1 * 1/2013 Lai ..... B05B 1/3026 239/526
2014/0054399 A1 * 2/2014 Hsieh ..... B05B 1/3026 239/526
2015/0343467 A1 * 12/2015 Chen ..... B05B 9/01 239/526

* cited by examiner

*Primary Examiner* — Christopher Kim
(74) *Attorney, Agent, or Firm* — Che-Yang Chen; Law Offices of Scott Warmuth

(57) ABSTRACT

A gardening water spray gun may include a barrel portion and a handle, and a water control chamber laterally penetrates through the water spray gun. A water control valve pivotally secured inside the water control chamber is controlled by an operating unit. The water control valve is a circular shaft which has an upper arc edge and a lower arc edge, and a central portion of the lower arc edge comprises a through hole which penetrates through the water control valve from a side to another. Moreover, a recess formed at an end of the through hole is located close to the upper arc edge, and with the communication between the through hole and the recess, the water spray gun is configured to allow more water to flow through and to provide a large amount of spraying water at one time.

5 Claims, 8 Drawing Sheets

GARDENING WATER SPRAY GUN

FIELD OF THE INVENTION

The present invention relates to a gardening water spray gun, and more particularly to a gardening water spray gun capable of providing a large volume of water.

BACKGROUND OF THE INVENTION

To overcome a disadvantage that a user needs to press a button or a handle to allow a conventional water spray gun to continuously spray water, referring to FIGS. 7 to 9, a kind of water spray gun, as disclosed in my previous invention, comprises a main body (50), an axle bolt (60), a mounting unit (70), a control unit (80) and a sealing cover (90). The main body (50) has a handle (51) and a barrel portion (52) which are connected to each other, and a cover (53) covers around outer surfaces of the handle (51) and the barrel portion (52). Also, a first O-ring (521) is disposed on a front portion of the barrel portion (52), thereby achieving the water sealing-effect of the main body (50). A front end of the barrel portion (52) is connected to a base (54) which is configured to connect to a spray head (55), and a holding portion (56) is connected the handle (51) and the barrel portion (52) at two ends thereof. Furthermore, the handle (51) has a water control chamber (511) laterally penetrating through an upper portion thereof, and the water control chamber (511) is communicated with a water inlet channel (512) of the handle (51) and a water outlet channel (522) of the barrel portion (52). The handle (51) and the barrel portion (52) is connected with an angle, and an outer corner of the connection has an arc surface (513). Moreover, two blocking pieces (514) are respectively formed at an upper end and a lower end of the arc surface (513), and the spray head comprises a plurality of spray holes (551) which are configured to perform different patterns of spraying water such as solid stream, full cone, or other various patterns. In addition, a locating unit (57) comprising at least s spring and a locating column is secured between the base (54) and spray head (55). A first lateral edge of the axle bolt (60) has a water flowing hole (61) which is cut and shaped into a preferred angle, and a through hole (62) formed at a bottom end of the water flowing hole (61) penetrates through an opposite side of the first later edge of the axle bolt (60). The axle bolt (60) is configured to be turned by a user to selectively block the through hole (62) in different levels, thus controlling the on/off operation and water amount of the water spray gun. A first end of the axle bolt (60) has a first peripheral groove (63) which is configured to be disposed by a second O-ring (631), and a second end of the axle bolt (60) is connected to a connecting tube (66) which has a smaller diameter than the second end of the axle bolt (60). Moreover, the first peripheral groove (63) is connected to a first blocking edge (64) which has a larger diameter than the first peripheral groove (63). Furthermore, an inner surface of the blocking edge (64) close to the first peripheral groove (63) comprises two first engaging pieces (65) which are respectively formed at two corresponding positions. Additionally, two second engaging pieces (67) formed in hook shapes are respectively located at a top portion and a bottom portion of an outer periphery of the connecting tube (66). A second blocking edge (71) formed at a first end of the mounting unit (70) has a larger diameter than the mounting unit (70), and the second end of the mounting unit (70) comprises an axial connecting hole (73). An inner surface of the second blocking edge (71) close to the second end of the mounting unit (70) has two blocks (72) which are respectively formed at two corresponding positions, and two engaging holes (74) are respectively formed at a top portion and a bottom portion of an inner periphery of the connecting hole (73). An outer periphery of the mounting unit (70) has a second periphery groove (75) which is configured to be disposed by a sealing ring (751). The control unit (80) has two parallel rotating arms (71), and a pressing piece (82) is connected to the two rotating arms (71) at two ends thereof. Each of the two rotating arms (71) has a stepped hole (83) laterally penetrating through a central portion thereof, and each of the two stepped holes (83) has two engaging slots (84) respectively formed on an inner periphery thereof at two corresponding positions. In assembly process, the sealing cover (90) secured inside the main body (50) located between the water control chamber (511) of the handle (51) and the barrel portion (52), and the two rotating arms (81) of the control unit (80) are respectively borne against two lateral ends of the water control chamber (511) so as to allow the pressing piece (82) to couple and move on the arc surface (513) with a limited displacement. After the control unit (80) is coupled on the main body (50), the two stepped holes (83) are aligned with the two lateral ends of the water control chamber (511) such that the axle bolt (60) is configured to penetrate through the first stepped hole (83), the water control chamber (511), and the second stepped hole (83) to connect to the mounting unit (70). Wherein the axle bolt (60) is firmly connected to the mounting unit (70) through connecting the connecting tube (66) to the connecting hole (73), and the two second engaging pieces (67) are respectively engaged with the two engaging holes (74). In the meantime, the first blocking edge (64) of the axle bolt (60) and the second blocking edge (71) of the mounting unit (70) are respectively coupled in the two stepped holes (83) of the control unit (80), and the two first engaging pieces (65) of the axle bolt (60) and the two blocks (72) of the mounting unit (70) are respectively engaged in the engaging slots (84) on the two control unit (80) such that the control unit (80), the axle bolt (60) and the mounting unit (70) are configured to be linked and moved synchronously.

However, the water spray gun of my previous invention still has its disadvantages because: the through hole (62) connecting to the water flowing hole (61) has a smaller diameter, and it cannot allow a large volume of water to flow through at one time, which limits the volume of spraying water. Therefore, there remains a need for a new and improved design for a water spray gun to overcome the problems presented above.

SUMMARY OF THE INVENTION

The present invention provides a gardening water spray gun which comprises a barrel portion and a handle, and a water control chamber laterally penetrates through the water spray gun. A water outlet channel is formed inside the barrel portion, and the handle has a water inlet channel formed therein. Also, the water outlet channel, the water control chamber and the water inlet channel are communicated with each other. A water control valve pivotally secured inside the water control chamber is controlled by an operating unit. The operating unit is configured to be pulled upwardly or downwardly to rotate the water control valve such that the water control valve is configured to be aligned or misaligned with the water inlet channel and the water outlet channel, thus controlling on/off operation of the water spray gun or the amount of spraying water. A spray head is connected to a front end of the barrel portion. The water control valve penetrating through the water control chamber is connected to a locating lid, and the connection of the water control valve and the locating lid is configured to secure the operating unit on the water spray gun. Wherein the water control valve is a circular shaft which has an upper arc edge and a lower arc edge, and a central portion of the lower arc edge comprises a through hole which penetrates through the water control valve from a side to another. Moreover, a recess formed at an end of the through hole is located close to the upper arc edge, and with the communication between the through hole and the recess, the water spray gun is configured to allow more water to flow through and to provide a large amount of spraying water at one time.

Comparing with conventional water spray gun, the present invention is advantageous because: by using the through hole to directly penetrate the water control valve, the diameters of the water flowing channels in the water spray gun are not narrowed in manufacturing process. Moreover, with the through hole cooperating with the recess, the water spray gun is configured to allow more water to flow therein and to provide a large amount of spraying water at one time.

BRIEF DESCRIPTION OF THE DRAWINGS

FIG. 5 is a schematic view illustrating the gardening water spray gun of the present invention is turned on.

FIG. 6 is a schematic view illustrating the gardening water spray gun of the present invention is fully turned on.

DETAILED DESCRIPTION OF THE INVENTION

Figure 1:
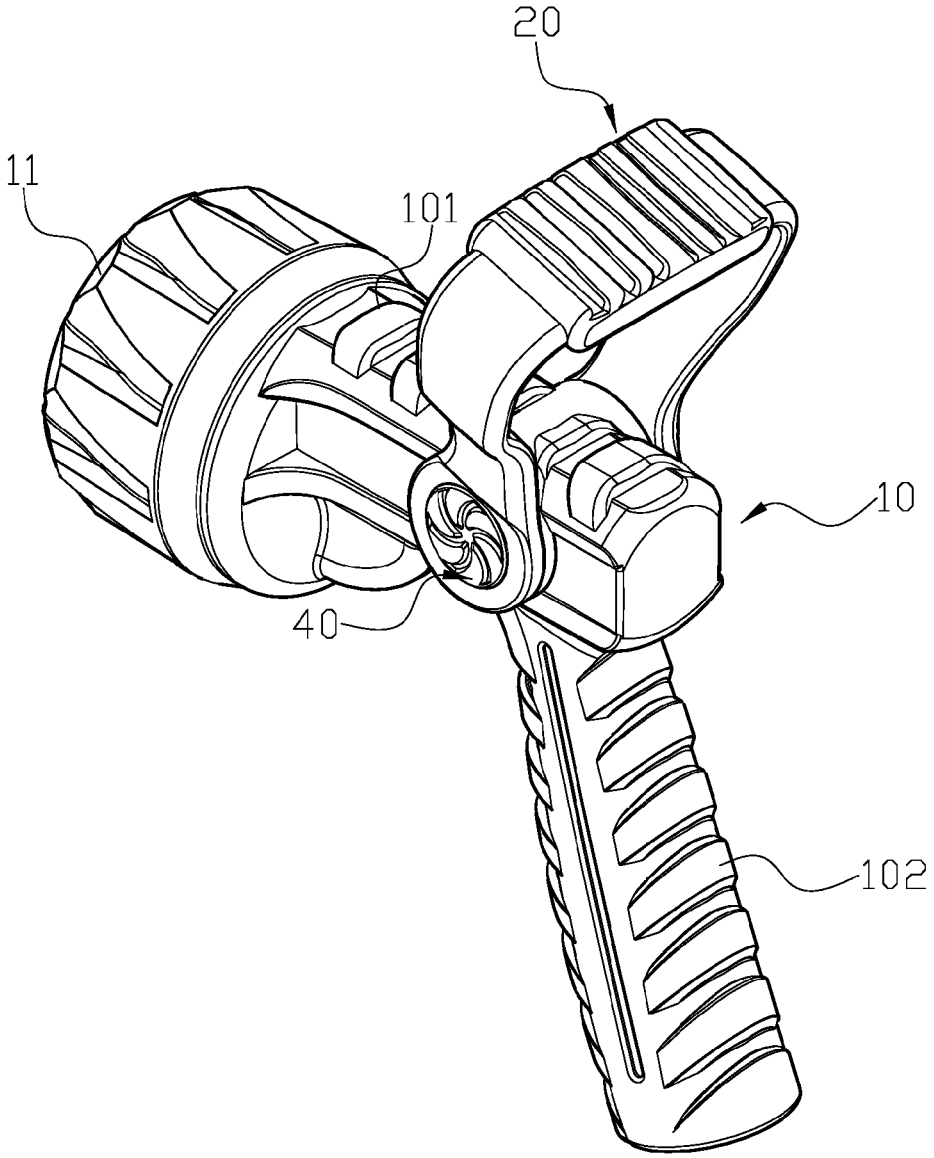
FIG. 1 is a three-dimensional assembly view of a gardening water spray gun of the present invention.
Figure 3:
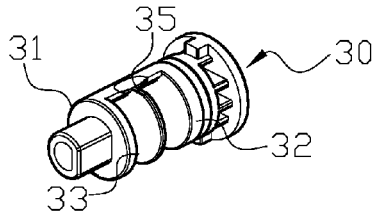
FIG. 3 is an assembly view from another angle of the gardening water spray gun of the present invention.
Figure 2:
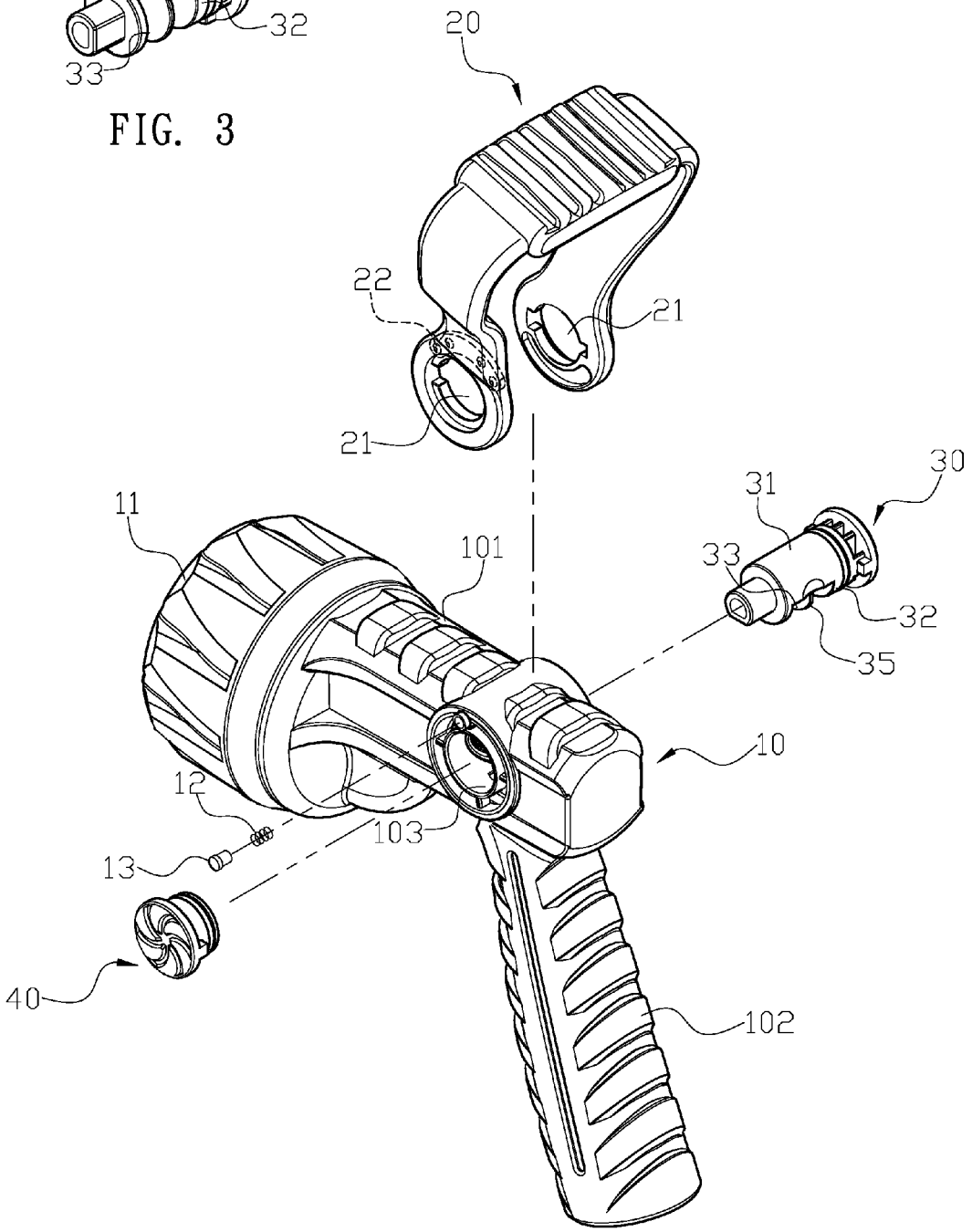
FIG. 2 is a three-dimensional exploded view of the gardening water spray gun of the present invention.

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

In order to further understand the goal, characteristics and effect of the present invention, a number of embodiments along with the drawings are illustrated as following:

Referring to FIGS. 1 to 4, the present invention provides a gardening water spray gun (10) which comprises a barrel portion (101) and a handle (102), and a water control chamber (103) laterally penetrates through the water spray gun (10). A water outlet channel (104) is formed inside the barrel portion (101), and the handle (102) has a water inlet channel (105) formed therein. Also, the water outlet channel (104), the water control chamber (103) and the water inlet channel (105) are communicated with each other. A water control valve (30) pivotally secured inside the water control chamber (103) is controlled by an operating unit (20). The operating unit (20) is configured to be pulled upwardly or downwardly to rotate the water control valve (30) such that the water control valve (30) is configured to be aligned or misaligned with the water inlet channel (105) and the water outlet channel (104), thus controlling on/off operation of the water spray gun (10) or the amount of spraying water. A spray head (11) is connected to a front end of the barrel portion (101). The water control valve (30) penetrating through the water control chamber (103) is connected to a locating lid (40), and the connection of the water control valve (30) and the locating lid (40) is configured to secure the operating unit (20) on the water spray gun (10). Wherein the water control valve (30) is a circular shaft which has an upper arc edge (31) and a lower arc edge (32), and a central portion of the lower arc edge (32) comprises a through hole (33) which penetrates through the water control valve (30) from a side to another. Moreover, a recess (34) formed at an end of the through hole (33) is located close to the upper arc edge (31), and with the communication between the through hole (33) and the recess (34), the water spray gun (10) is configured to allow more water to flow through and to provide a large amount of spraying water at one time.

In one embodiment, each of two ends of the operating unit (20) has an engaging hole (21), and the two engaging holes (21) are configured to be aligned with the water control chamber (103) at two ends thereof such that the water control valve (30) is configured to sequentially penetrate through the first engaging hole (21), the water control chamber (103) and the second engaging hole (21) to engage with the locating lid (40), thus securing the operating unit (20) and the water control valve (30) on the water spray gun (10) and allowing the operating unit (20), the water control valve (30) and the locating lid (40) to be linked and moved synchronously.

In another embodiment, the water control valve (30) is connected to the locating lid (40) through high frequency welding process.

In still another embodiment, a plurality of locating slots (22) formed at an inner side of the operating unit (20) are located along either of two upper edges of the two engaging holes (21), and a plurality of locating units formed on the water spray gun (10) are located at positions corresponding to the locating slots (22). Wherein each of the locating units comprises a spring (12) and a locating bolt (13).

In a further embodiment, at least a partition (35) formed inside the through hole (33) of the water control valve (30) is extended toward the recess (34).

Figure 4:
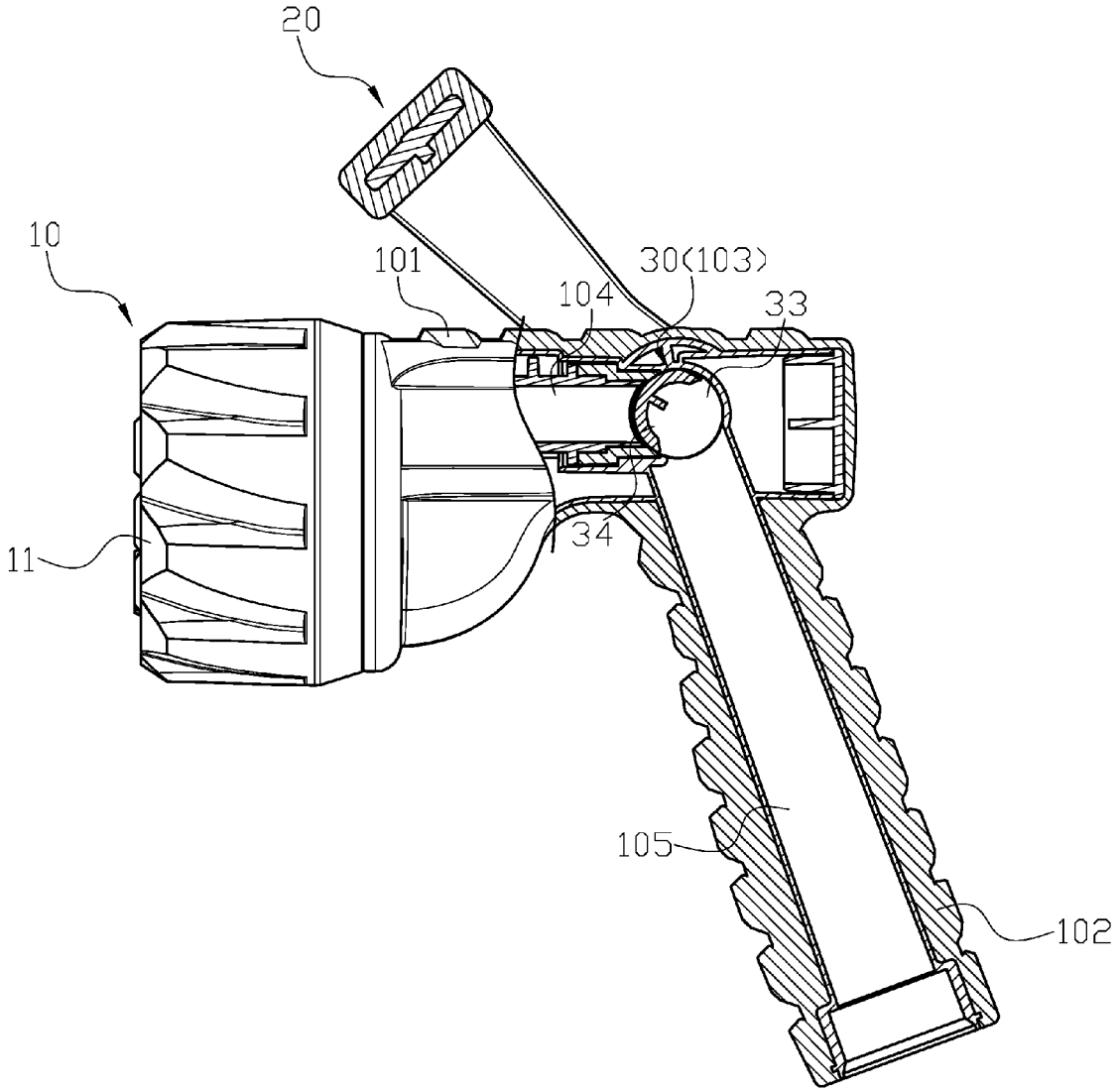
FIG. 4 is a schematic view illustrating the gardening water spray gun of the present invention is at off position.
Figure 5:
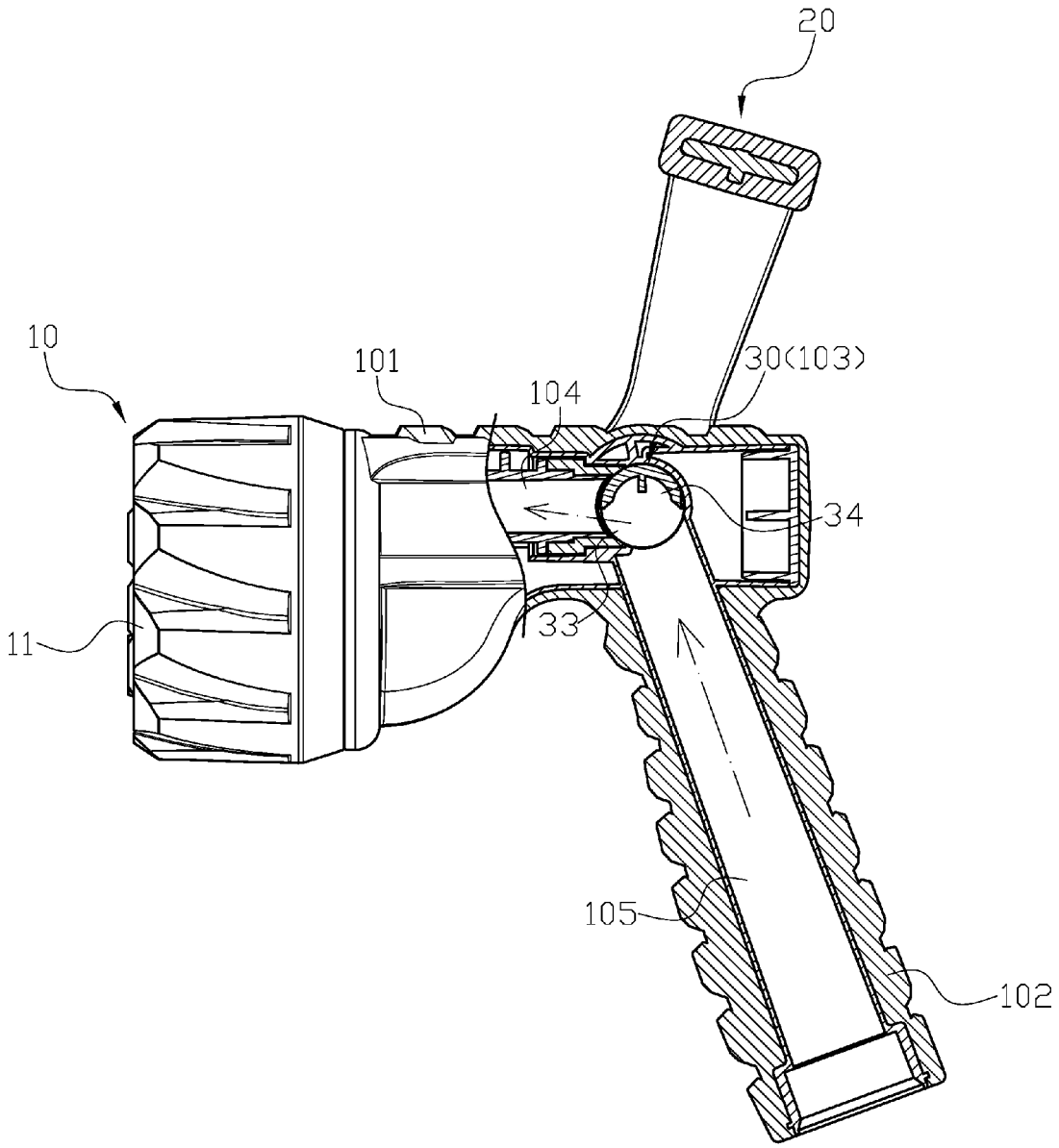
Figure 6:
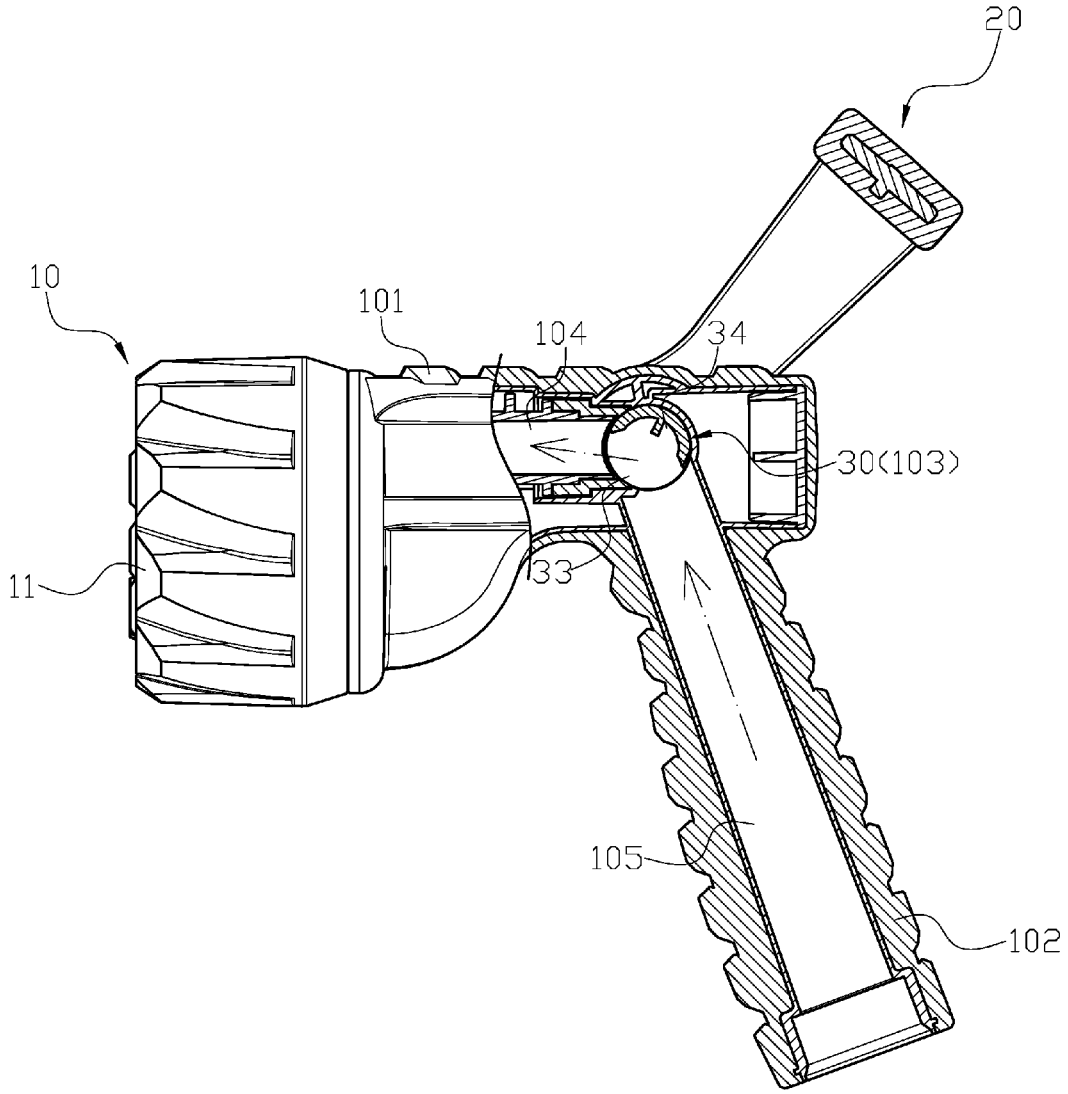
Figure 7:
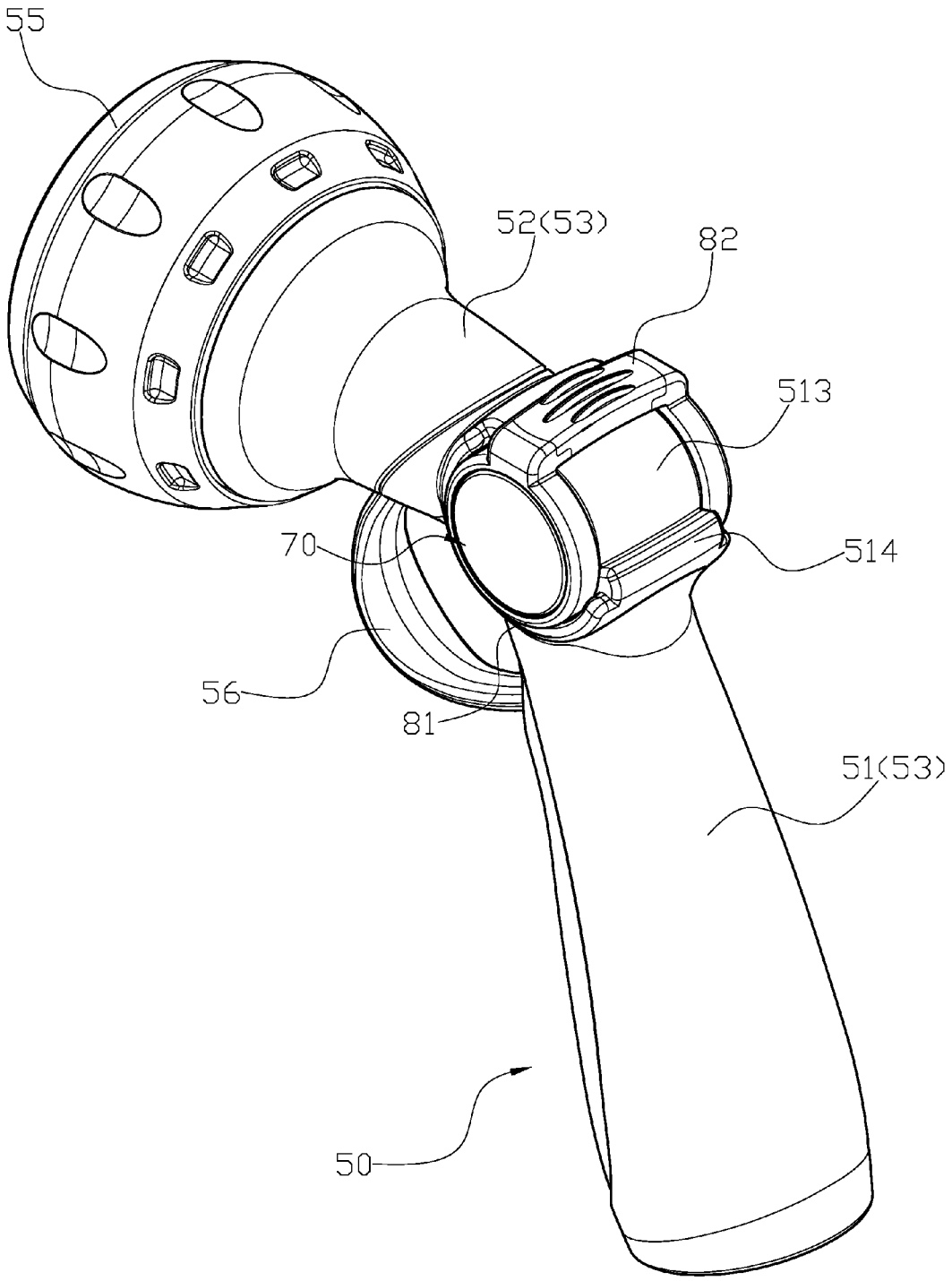
FIG. 7 PRIOR ART
FIG. 7 is a prior art.
Figure 8:
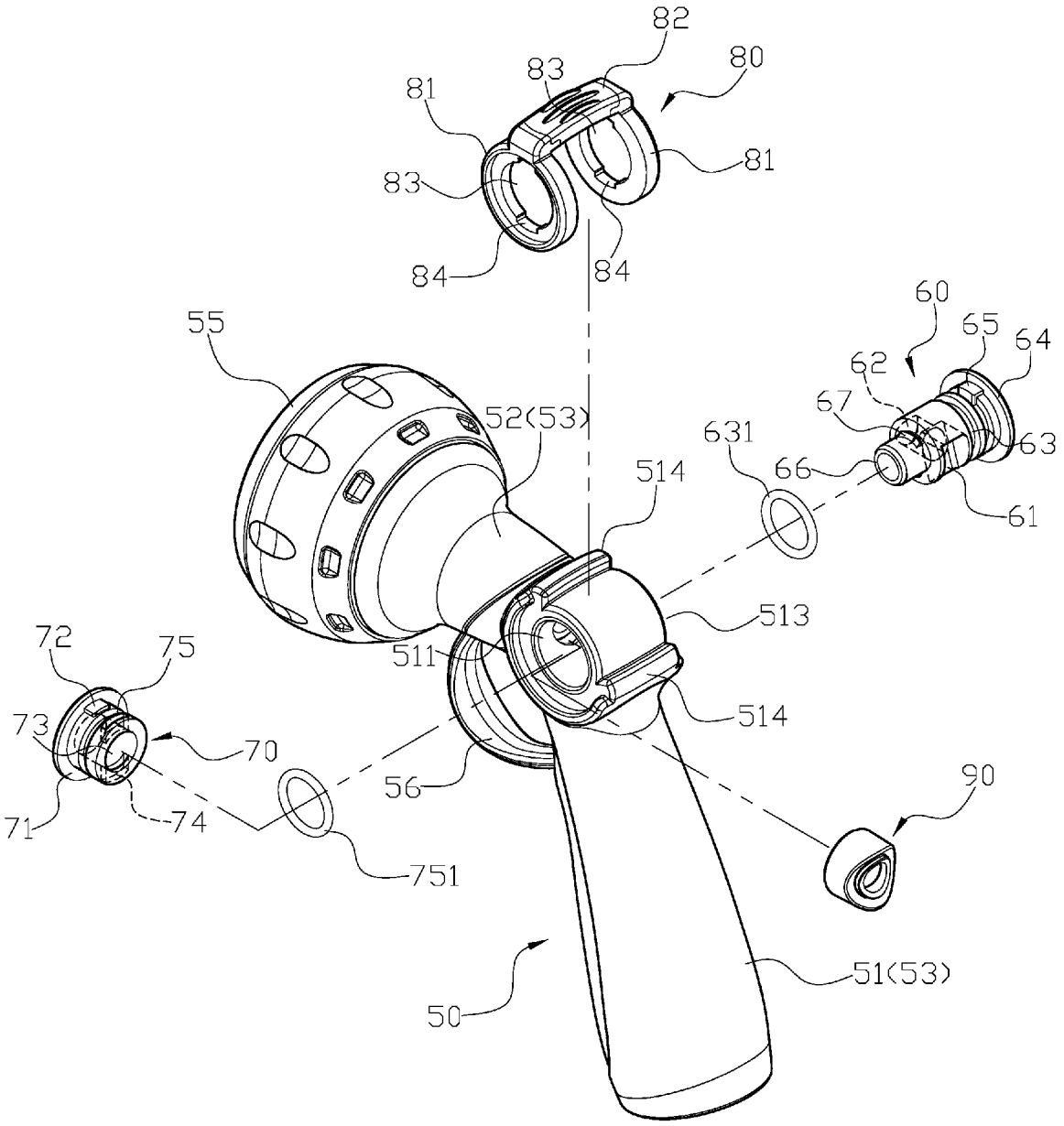
FIG. 8 PRIOR ART
FIG. 8 is a prior art.
Figure 9:
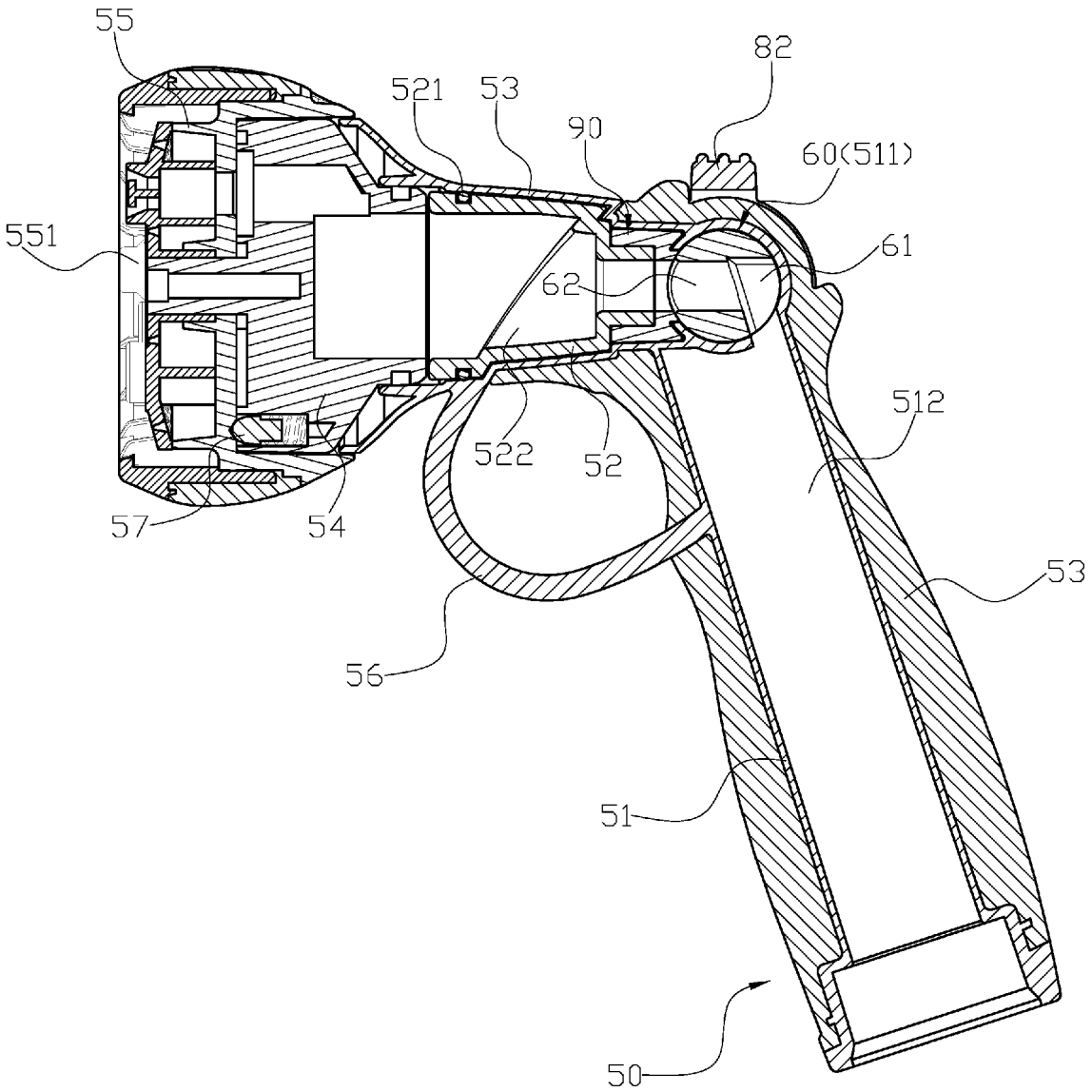
FIG. 9 PRIOR ART
FIG. 9 is a prior art.

In actual application, a user can pull the operating unit (20) in a first direction to drive the water control valve (30) and allow the through hole (33) of the water control valve (30) to be completely misaligned with the water outlet channel (104) of the water spray gun (10), thus turning off the water spray gun (10) (as shown in FIG. 4). On the other hand, the water spray gun (10) is configured to provide water flow by pulling the operating unit (20) in an opposite direction. By this time, the water outlet channel (104) is configured to communicate with the water inlet channel (105) through the through hole (33), thus allowing the water to spray out of the water spray gun (10). Moreover, the amount of spraying water can be adjusted and controlled through the pulling angles of the operating unit (20) (as shown in FIGS. 5 and 6).

Comparing with conventional water spray gun, the present invention is advantageous because: by using the through hole (33) to directly penetrate the water control valve (30), the diameters of the water flowing channels in the water spray gun (10) are not narrowed in manufacturing process. Moreover, with the through hole (33) cooperating with the recess (34), the water spray gun (10) is configured to allow more water to flow therein and to provide a large amount of spraying water at one time.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A water spray gun comprising:

a barrel portion and a handle, and a water control chamber laterally penetrating through the water spray gun; a water outlet channel formed inside the barrel portion, and the handle having a water inlet channel which is formed therein, and the water outlet channel, the water control chamber and the water inlet channel communicated with each other; a water control valve, which is pivotally secured inside the water control chamber, controlled by an operating unit; wherein the operating unit is configured to be pulled upwardly or downwardly to rotate the water control valve such that the water control valve is configured to be aligned or misaligned with the water inlet channel and the water outlet channel, thus achieving on/off operation of the water spray gun or controlling the amount of spraying water; a spray head connected to a front end of the barrel portion; the water control valve, which penetrates through the water control chamber, connected to a locating lid, and the connection of the water control valve and the locating lid configured to secure the operating unit on the water spray gun; wherein the water control valve is a circular shaft which has an upper arc edge and a lower arc edge, and a central portion of the lower arc edge comprises a through hole which penetrates through the water control valve from a side to another; and a recess, which is formed at one end of the through hole and is communicated therewith to increase water flow volume.

2. The water spray gun of claim 1, wherein each of two ends of the operating unit has an engaging hole, and the two engaging holes are configured to be aligned with the water control chamber at two ends thereof such that the water control valve is configured to sequentially penetrate through the first engaging hole, the water control chamber and the second engaging hole to engage with the locating lid, thus securing the operating unit and the water control valve on the water spray gun and allowing the operating unit, the water control valve and the locating lid to be linked and moved synchronously.

3. The water spray gun of claim 1, wherein the water control valve is secured with the locating lid through high frequency welding process.

4. The water spray gun of claim 1, wherein a plurality of locating slots are formed at an inner side of the operating unit, and a plurality of locating units formed on the water spray gun are located at positions corresponding to the locating slots; and wherein each of the locating units comprises a spring and a locating bolt.

5. The water spray gun of claim 1, wherein at least a partition formed inside the through hole of the water control valve is extended toward the recess.

* * * * *